US010767870B2

(12) United States Patent
Budich

(10) Patent No.: US 10,767,870 B2
(45) Date of Patent: Sep. 8, 2020

(54) CLEANING AGENT FOR CLEANING COMMERCIAL COOKING DEVICES

(71) Applicant: BUDICH INTERNATIONAL GMBH, Hiddenhausen (DE)

(72) Inventor: Meinrad Budich, Hüllhorst (DE)

(73) Assignee: BUDICH INTERNATIONAL GMBH, Hiddenhausen (DE)

( * ) Notice: Subject to any disclaimer, the term of this patent is extended or adjusted under 35 U.S.C. 154(b) by 211 days.

(21) Appl. No.: 15/580,374

(22) PCT Filed: Jun. 1, 2016

(86) PCT No.: PCT/EP2016/062314
§ 371 (c)(1),
(2) Date: Dec. 7, 2017

(87) PCT Pub. No.: WO2016/198292
PCT Pub. Date: Dec. 15, 2016

(65) Prior Publication Data

US 2018/0299137 A1 Oct. 18, 2018

(30) Foreign Application Priority Data

Jun. 8, 2015 (DE) ..... 10 2015 109 017

(51) Int. Cl.
*F24C 14/00* (2006.01)
*B08B 9/08* (2006.01)
(Continued)

(52) U.S. Cl.
CPC ..... *F24C 14/005* (2013.01); *B08B 9/08* (2013.01); *B08B 3/08* (2013.01); *B08B 3/10* (2013.01);
(Continued)

(58) Field of Classification Search
CPC . F24C 14/005; B08B 9/08; B08B 3/08; B08B 2230/01; B08B 2203/007; B08B 3/10
See application file for complete search history.

(56) References Cited

U.S. PATENT DOCUMENTS 6,180,578 B1 1/2001 Hemm et al.
2002/0147124 A1 10/2002 Klos et al.
(Continued)

FOREIGN PATENT DOCUMENTS

DE 100 60 204 B4 4/2004
DE 10 2004 004 393 B3 5/2005
(Continued)

OTHER PUBLICATIONS

International Search Report issued in PCT/EP2016/062314; dated Sep. 12, 2016.
(Continued)

*Primary Examiner* — Benjamin L Osterhout
(74) *Attorney, Agent, or Firm* — Studebaker & Brackett PC

(57) ABSTRACT

The present invention relates to a method for cleaning a commercial cooking device (100, 100'), in which a container (B, B') with a solid cleaning agent (1R), in particular a firm gel, is accommodated in a connection unit (101, 102) of the commercial cooking device (100, 100'), and in which the solid cleaning agent (1R) is liquefied in the cleaning process in the container (B, B') by means of heat and/or a solvent, preferably water and/or steam, in order to generate a liquefied cleaning agent. In addition, the invention relates to the use of a container (B, B') with a solid cleaning agent (1R) for cleaning a commercial cooking device (100, 100'). Finally, the present invention relates to a corresponding container (B, B') with a solid cleaning agent (1R) for cleaning commercial cooking devices.

5 Claims, 4 Drawing Sheets

(51) Int. Cl.
*B08B 3/08* (2006.01)
*B08B 3/10* (2006.01)

(52) U.S. Cl.
CPC ..... *B08B 2203/007* (2013.01); *B08B 2230/01* (2013.01)

(56) References Cited

U.S. PATENT DOCUMENTS

| | | | |
|---|---|---|---|
| 2007/0157920 | A1 | 7/2007 | De Miranda Grieco |
| 2016/0186107 | A1* | 6/2016 | Budich ..... C11D 17/0078 510/218 |
| 2016/0341431 | A1 | 11/2016 | Topfer |

FOREIGN PATENT DOCUMENTS

| | | | |
|---|---|---|---|
| DE | 10 2006 006 153 | A1 | 8/2007 |
| DE | 10 2007 005 503 | A1 | 7/2008 |
| DE | 10 2008 039 073 | A1 | 3/2010 |
| DE | 20 2010 013 989 | U1 | 2/2011 |
| DE | 102013113298 | A1 | 6/2015 |
| DE | 10 2013 021 732 | A1 | 7/2015 |
| EP | 1 209 419 | A2 | 5/2002 |
| EP | 2 502 542 | A1 | 9/2012 |
| EP | 2 905 069 | A1 | 8/2015 |
| WO | 97/41203 | A1 | 11/1997 |
| WO | 2012/048680 | A1 | 4/2012 |
| WO | 2015/056063 | A1 | 4/2015 |
| WO | 2016/016351 | A1 | 2/2016 |

OTHER PUBLICATIONS

An Office Action mailed by the European Patent Office dated Apr. 4, 2019, which corresponds to European Patent Application No. 16726531.0-1009 and is related to U.S. Appl. No. 15/580,374.

* cited by examiner

CLEANING AGENT FOR CLEANING COMMERCIAL COOKING DEVICES

The present invention relates to a method for cleaning a commercial cooking device with a solid cleaning agent as well as to the use of a solid cleaning agent for cleaning a commercial cooking device. Finally, the present invention involves a solid cleaning agent for cleaning commercial cooking devices.

A commercial cooking device is here understood as a device that usually has commercial uses, for example in canteen kitchens, culinary establishments and bakeries, outlets, etc., for thermally preparing (cooking) and/or heating foods. In particular, these include cooking appliances, grills, ovens, automatic ovens, steam cookers, combination steamers, microwave ovens or deep fryers. The method is used in particular for internally cleaning the commercial cooking device, above all its cooking chamber, in which the meals are usually prepared.

One special problem exists in particular for devices that operate with water and/or steam, for example steam cookers or combination steamers. As a rule, such devices have a line system with chambers, valves, pumps, etc., so as to supply water and/or steam to the cooking chamber or move the water and/or steam around in a circulating loop created by the line system. This line system cannot be accessed for manual cleaning, but still has to be kept hygienically clean. In general, high-alkaline cleaning agents are suitable for ensuring the necessary hygiene.

High-alkaline cleaning agents are today commercially available in a wide variety of presentation forms, for example as powders, granules, liquids, melting blocks or as pressed tablets. Powders, granules or liquids have proven effective for mechanically cleaning hard surfaces by hand, while pressed tablets or melted and then cooled block-shaped cleansers are used in addition to powders, granules or liquids for machine cleaning hard surfaces, e.g., machine cleaning dishes. The advantage to tablets and melting blocks over powders is that they can be accurately and easily dosed, do not make any dust, and are easy to handle. For example, these advantages can be used in household dishwashers or commercial dishwashers, wherein the high-alkaline cleaner is in both cases used for the process of cleaning the machine itself (i.e., not during the dishwashing process). In commercial cooking devices as well, tablets have to date been manually placed in the cooking chamber, for example in proximity to a water/steam inlet (e.g., located in a fan propeller or present as a nozzle device in the cooking chamber), after which a cleaning program is started, during which water and/or steam are then supplied.

However, tablets and melting blocks were also found to have disadvantages. Breakage can arise precisely in tablets; naturally, tablets damaged in this way no longer offer the advantage of sufficient and accurate dosing. Another problem with tablets lies in the fact that the desired water solubility cannot always be ensured, i.e., tablets sometimes dissolve either too fast or too slow. Such a problem is encountered in particular if a rinsing process is to be performed after a cleaning process, for example. Precisely residual constituents of tablets can thus undesirably influence the effectiveness of the rinsing agent or make the rinsing agent ineffective. As a consequence, a reduced efficiency of the cleaning agent or rinsing agent leads to an inadequate cleaning or rinsing result, to even include undesirable deposits and a resultantly impaired functionality of the cooking device.

When using high-alkaline, corrosive cleaning agents in the conventional form as powders, tablets, granules or liquids, there is also the danger of the cleaner and/or rinsing agent being spilled or sprayed, thereby coming into contact with the skin or eyes of the user. Therefore, the user at the very least must wear gloves and protective goggles when dosing such high-alkaline cleaners.

Known from practice are containers that comprise cleaning agents and/or rinsing agents for steam cookers. Notable here in particular are so-called "two in one" cleaning cartridges from MKN (Maschinenfabrik Kurt Neubauer, Germany), for example which combine a cleaner and rinsing agent. In these cleaner cartridges, the cleaner and rinsing agent are coated one over the other, and separated from each other by a wax separating layer. The cleaner is here arranged in the upper part of the cartridge, i.e., in the outlet. It is in turn sealed off by a wax layer. These cartridges are arranged in a bracket fixedly mounted to the wall of the cooking chamber overhead in the cooking chamber for cleaning the steam cooker. The hot steam generated in the cleaning mode in the same or similar manner as when steam cooking, and/or the temperature set in the cooking chamber during the cleaning process first melts the wax layer above the cleaner, allowing the cleaner to enter the cooking chamber. After the cleaning process has concluded, the temperature is increased, which causes the wax separating layer between the cleaner and rinsing agent designed for this higher temperature to melt. This then releases the rinsing agent. However, such cartridges are relatively complicated to manufacture, and thus associated with a high cost outlay. In addition, such an arrangement requires a strict observance of the chemical composition, since even a slight variation can lead to the premature dissolution or even insolubility of the wax layer. An application-oriented chemical composition for such a system is thus subject to limitations.

An object of the present invention is to provide a way to clean a commercial cooking device with an alkaline cleaning agent and optionally a rinsing agent, which enables cleaning with a reduced effort, without the user intentionally or unintentionally coming into contact with the cleaning agent. Such a method preferably makes it possible to reduce costs and also use variable chemical compositions.

This object is achieved on the one hand by a method for cleaning a commercial cooking device as well as by the use of a solid cleaning agent arranged in a container and a container with this solid cleaning agent for cleaning a commercial cooking device.

According to the invention, the method for cleaning a commercial cooking device comprises a container with a preferably high-alkaline solid cleaning agent, which is accommodated in a connection unit of a commercial cooking device. The solid cleaning agent is especially preferably designed as a solid gel, as will be explained later on. For the cleaning process, the solid cleaning agent is liquefied immediately or directly in the container by means of heat and/or a solvent, preferably water and/or steam, so as to generate a liquefied cleaning agent, and during liquefaction gradually moves out of the container when the opening of the container in the "overhead" position is directed downward or downwardly inclined.

Within the meaning of the present invention, a container is here designed in such a way that its interior has a hollow space, in which the solid cleaning agent is located during storage and up until its use. Therefore, such a container can be permanently stored and transport the solid cleaning agent. For example, it can here be a plastic bottle, a plastic tank or the like. In particular, the container is designed so that its material can withstand a high-alkaline solid cleaning agent. This also holds true when heating the container to temperatures of over 100° C. and/or for a high-alkaline, liquefied cleaning agent. An upper, front end of the container also has a closure aperture (for example, a bottle neck with a cover or sealing cap or the like), so that a liquefied cleaning agent can exit the container with the latter in an "overhead" position.

There are various ways of realizing the liquefaction of the solid cleaning agent, and those will be explained in greater detail later. A solvent potentially to be used here within the meaning of the invention can thereby serve to liquefy the solid cleaning agent or support liquefaction. Provided only a slight amount of solvent is used for liquefaction if any, the cleaning agent liquefied in this way can initially form a cleaning concentrate, which can preferably be further liquefied as needed later on. In an embodiment, the solid cleaning agent can initially be liquefied via the liquefaction device, and be further liquefied at a later point in time, for example after transferred into a supply tank, in particular a circulation container, with the addition of solvent, preferably fresh water. In other variants, the container with the solid cleaning agent is placed directly in the cooking chamber.

Within the meaning of the invention, a solid cleaning agent is here understood as a cohesive, solid mass of solid cleaning agent (hereinafter also referred to as solid cleaning agent mass), which is located in the container, such as a solid wax or a waxy composition like a gel, in particular a solid gel, or the like. Loose particle compositions or bulk material, like powders or granules, etc., are not included by the latter, for example. In a preferred composition, the solid cleaning agent is designed like a homogeneous, waxy mass with undissolved solids.

As mentioned, the solid cleaning agent has a pasty consistency in a preferred embodiment, in particular a solid gel form. Within the meaning of the invention, "solid gel form" is here preferably understood to mean a firm and/or waxy gel, meaning that a cut made into the gel with a knife remains visible as a cut. For example, such a cleaning agent, in particular a gel, can be filled into a container in the liquid state, "harden" therein, and then achieve a solid consistency to form the solid cleaning agent (or cohesive solid cleaning agent mass).

Such gels are known as dishwashing detergents in prior art. For example, DE 31 38 425 A1 already described pasty cleaning agents for washing dishes based on silicate. The rheological behavior of the cleaners described therein is designed in such a way that a gel-like paste liquefies when subjected to mechanical forces, for example when shaken or pressurized on a deformable storage bottle or tube or with a dosing pump, and can be easily sprayed out of a nozzle. In like manner, DE 19 507 532 A1 discloses a corresponding aqueous, pasty cleaning agent for washing dishes based on sodium hydroxide. In principle, the composition of a solid cleaning agent for the invention can be designed in a manner similar to the mentioned publications if the required alkalinity is correspondingly set.

A subject matter of the present invention further relates to a container with such a solid cleaning agent for cleaning a commercial cooking device according to the mentioned method, as well as the use of a solid cleaning agent (or solid cleaning agent mass) arranged in the container for cleaning a commercial cooking device, preferably a commercial cooking appliance, a grill, an oven, an automatic oven, a steam cooker, a combination steamer, a microwave oven or a deep fryer, in particular for cleaning its cooking chamber.

A container with a solid cleaning agent used according to the invention here also does not allow the solid cleaning agent to run out of the open container even in an "overhead" position". The method according to the invention can be used to first liquefy the alkaline solid cleaning agent and thereby dissolve it out of the container, without a manual dosing being required for this purpose. In other words, the user can dock the container with the solid cleaning agent mass to the connection unit as delivered, as will be explained below. In like manner, this averts or significantly reduces the danger of the cleaner being spilled or sprayed, and thereby coming into contact with the skin or eyes of the user. This advantageously avoids contact with the solid cleaning agent and the danger associated herewith. Use does not require any additional protection, such as gloves or protective goggles.

Components that were completely or at least partially integrated into the commercial cooking device can also be used in implementing the method according to the invention. The cleaning method according to the invention can thus use a line system of a circulating loop of the cooking device that is present anyway, and usually used for transporting or circulating water and/or steam and/or supplying fresh water. The advantage to this is that this water or steam line system is inevitably also cleaned.

Consequently, the method according to the invention for cleaning a commercial cooking device can have in particular a controller for various components or elements of the cooking device, so that the cooking device, preferably its cooking chamber and in particular the line system, can be cleaned according to the described cleaning method. A control device used for this purpose can also be part of an overall control device of the cooking device, which also controls the further operation of the cooking device when preparing the meals. In particular, such an overall controller of the cooking device can also be used for cleaning according to the invention by modifying the overall controller in a suitable manner. This is at least partially also possible by correspondingly adjusting the firmware of a controller, if the overall controller has a corresponding processor unit, for example a microprocessor or the like, which is equipped with firmware.

Of course, the method according to the invention yields an optimal cleaning efficiency. The specific concentration of cleaning agent here depends on the desired application, and is familiar to the expert.

Additional especially advantageous embodiments and further developments of the invention may be derived from the following description, wherein features from different exemplary embodiments can be combined into new exemplary embodiments.

In a preferred embodiment, the container with the solid cleaning agent is accommodated in a bracket fastened in the cooking chamber of the cooking device, which serves as a connection unit. Such a bracket is known in prior art, and is tightly and permanently fixed in the commercial cooking device or its cooking chamber by screw means (e.g., screws, etc.) or welded or soldered joints. The solid cleaning agent is here most easily, and thus preferably, liquefied by steam in the cooking chamber generated in the cleaning process, which can be generated in commercial cooking devices, in particular in steam cookers or combination steamers, in a conventional or similar way as when heating meals. During operation without steam, the temperature in the cooking chamber can also already be used for liquefaction in the cleaning process.

In an alternative embodiment, the container with the solid cleaning agent is accommodated in a connection unit that is separate from the cooking chamber, and has an allocated liquefaction device, which preferably has a heating device and/or rinsing nozzle. In a preferred embodiment, the connection unit is a connection piece. In order to ensure a tight connection between the container incorporating the solid cleaning agent and the connection unit, the connection unit or connection piece preferably has a receiving bush, preferably with a screw-driving or connecting device, in which the container can be easily and reliably secured.

The cleaning agent liquefied by such a liquefaction device is subsequently transferred into the cooking chamber of the cooking device via a line system, preferably comprising a pump. Use can optionally be made of at least one supply tank, in which the liquefied cleaning agent is initially kept and further liquefied as needed. In particular, this supply tank can also be a circulation container of a circulating loop.

In a preferred variant, the liquefaction device has a heating device, which is preferably designed in such a way that the container is heated in the connection unit, in particular of a connection piece. In particular, such a heating device can be designed in such a way as to be operated electrically and/or with warm water and/or condensing steam, etc. Heating the solid cleaning agent with a heating device advantageously causes the solid cleaner to melt. The alkaline solid cleaning agent can be set in such a way as to melt at an elevated temperature and can run out of the container under its own gravity. The solid cleaning agent preferably melts at a temperature of above 40° C., especially preferably at a temperature of at least 50° C., in particular at a temperature of at least 60° C. Under conventional storage conditions, a solid cleaning agent designed in this way does not melt even when stored under elevated temperature conditions, for example in the summer or in warmer climate zones.

In principle, the heating device could be arranged only on a narrower ring, for example on the container opening or on the bottle head. However, when thermally emptying the container, the entire bottle is advantageously heated to ensure complete emptying. To this end, special preference goes to a heated tubular receiving bush, into which the entire bottle is inserted.

The material of the connection unit, in particular of a connection piece with heating device, is preferably selected in such a way as to have good thermal conductivity. A preferred coefficient of thermal conductivity ($\lambda$) here lies within a range of 10 to 450 W/(m K), for example, preferably within a range of 15 to 400 W/(m K), in particular within a range of 20 to 300 W/(m K). Use can preferably be made of metals, in particular copper, and possibly also heat-conducting pastes or the like.

Alternatively or additionally, the liquefaction device can be equipped with a rinsing nozzle, i.e., alternatively or additionally to using a temperature increase for melting purposes, the alkaline solid cleaning agent can be dissolved out of the container by the solubility of an inflowing solvent, in particular a water jet and/or steam. The solution equilibrium is preferably selected in such a way that already adding a slight quantity of water again leads to a quasi-liquid, low-viscosity consistency of the cleaning agent.

As mentioned, a potentially used solvent for liquefying the solid cleaning agent can preferably consist simply of fresh water. In an alternative composition, the solvent can contain protic and/or aprotic solvents, preferably organic solvents, such as hexane and/or heptane and/or alcohols, in particular methanol, ethanol and propanol. Of course, a solvent within the meaning of the invention is suitable for application in commercial cooking devices.

The liquefied cleaning agent obtained in this way can preferably be transferred completely into a supply tank, if necessary directly into a circulation container of the circulating loop. A solvent feed to the supply tank can then be used by the liquefied cleaning agent, preferably in conjunction with a defined quantity of additional solvent, especially preferably fresh water, to form a concentrated solution, which has a sufficient alkalinity for a single cleaning process (individual dosing). The cleaning device then not only effects a successive dilution with water in the solid cleaning agent. Rather, such a supply here takes place in a controlled fashion, so as to ensure the desired concentration of cleaning agent at any one time.

In principle, however, the liquefied cleaning agent could also be introduced into the cooking chamber of the commercial cooking device immediately after the liquefaction process without adding any more solvent. The ready-to-use cleaning solution can be diluted more or less strongly depending on the degree of contamination. However, when supplying a concentrated cleaning solution, a preferred dilution with solvent lies within a range of 2:1 to 1:2, especially preferably within a range of 1.5:1 to 1:1.5, especially within a range of 1:1. For example, if the gel has a water content of approx. 35% w/w, and the stable, concentrated cleaning solution is to have a water content of roughly 70% w/w, the dilution with water is 1 to 1.

In a preferred embodiment, the alkaline solid cleaning agent is essentially emptied from the container, regardless of whether the container is placed directly into the cooking chamber or in a connection unit that is separate from the cooking chamber and has an allocated liquefaction device. "Essentially" is here understood as the solid cleaning agent being emptied from the container or cleaner bottle in a percentage of at least 90% w/w, preferably in a percentage of at least 95% w/w, and especially preferably in a percentage of at least 99% w/w.

Exposure to steam is also an especially well-suited way for essentially emptying the container with the solid cleaning agent, in particular the waxy or solid gel, since the latter can get to the entire interior surface of the container just by virtue of its physical consistency. As steam condenses on the interior surfaces of the container, heat is transmitted, and the concentration equilibrium also shifts to a higher water concentration. In other words, heat and solvent are here directly combined and used in the form of a heated solvent, specifically preferably steam. As a result of both, any residual solid cleaning agent, in particular solid gel, on the surfaces thins, and thereby essentially runs out of the container.

When spraying solvent, in particular water, this can also be achieved by correspondingly configuring and adjusting the spraying device in such a way that the entire interior surface of the container is exposed to water.

In order to be able to readily dissolve the solid cleaning agent with a solvent, preferably water or steam, especially preferred components of the solid cleaning agent, in particular of the solid or waxy gel, have a good water solubility.

Furthermore, the solid cleaning agent can be used in combination with other agents, without as a result losing its inventive variable consistency or strength, and its advantageous water solubility. In order to set a desired viscosity, the solid cleaning agents can thus contain glycols, glycol derivatives and/or certain alkanolamines, for example. The viscosity can also be set using the water content of the solid cleaning agent. A preferred water content of the solid cleaning agent here lies within a range of 5% w/w to 45% w/w, preferably within a range of 10% w/w to 40% w/w, in particular within a range of 15 to 35% w/w.

The alkaline properties of the solid cleaning agent can also be influenced by its content of alkaline components. In particular, the solid cleaning agent contains an alkali lye, preferably potash and soda lye, especially preferably soda lye. In particular, the advantage to a solid gel over a liquid alkaline cleaner is that the alkalis necessary for the cleaning process can be more highly concentrated. Therefore, a preferred content of NaOH in the solid cleaning agent lies within a range of 15 to 45% w/w, especially preferably within a range of 20 to 40% w/w, in particular within a range of 25 to 35% w/w. In an embodiment, the solid cleaning agent or the preferred waxy gel thus has a pH value of above 11, especially preferably a pH value of above 12, and in particular a pH value of above 13.

In addition, a preferred solid cleaning agent contains surfactants and/or paraffin oil and/or polyhydroxy compounds preferably with glycerin, glucose, glyoxal or propylene glycol as the carrier phase for other ingredients common in cleaners.

The surfactants used can be both anionic surfactants and cationic surfactants, amphoteric surfactants and nonionic surfactants. Anionic and/or nonionic surfactants are preferred surfactants for the solid cleaning agent. The cleaning performance is significantly influenced by the quantity of surfactant. However, the hardening duration of the solid cleaning agent after all components have been added also depends in particular on its concentration.

In particular, the solid cleaning agent can additionally contain a builder substance in a quantity of up to 60% w/w, preferably 15 to 40% w/w. The builder substance preferably has a high water solubility. Possible builder substances include alkali phosphates, which can be present in the form of their sodium or potassium salts. Examples thereof include: tetrasodium diphosphate, pentasodium triphosphate, so-called sodium hexametaphosphate along with the corresponding potassium salts or mixtures of sodium and potassium salts. Further to be mentioned are complexing agents, e.g., nitriolotriacetate or ethylenediaminetetraacetate. Builder substances also include soda and borax within the framework of the present invention. A preferred builder substance of the solid cleaning agent is methylglycinediacetic acid (MGDA), for example which is available from BASF under the name Trilon® M.

Additional possible water-soluble builder components include organic polymers of a native or synthetic origin, above all polycarboxylates. For example, these can be polyacrylic acids and copolymers of maleic acid anhydride and acrylic acid, as well as the sodium salts of these polymeric acids. Commercially available products include Sokalan® CP 5 and PA 50 from BASF, and Alcosperse® 175 from Akzonobel. For example, suitable native polymers can be oxidized starch (e.g., DE 42 28 786) and polyamino acids like polyglutamic acid or poly aspartic acid, for example from Cygnus, Bayer and Rohm & Haas.

Also possible as builder components are naturally occurring hydroxycarboxylic acids, e.g., mono, dihydroxy-succinic acid, α-hydroxypropionic acid, citric acid, gluconic acid, as well as salts thereof. Polyepoxysuccinic acid (PESA) is a preferred hydroxycarboxylic acid as a builder component for the solid cleaning agent. Citrates are preferably used in the form of trisodium citrate dihydrate.

Other builder substances are amorphous metasilicates or sheet silicates. Crystalline sheet silicates are also suitable builders, provided they are sufficiently alkali stable.

Especially preferred builder substances are selected from the group of pentasodium triphosphate, trisodium citrate, nitrilotriacetate, ethylene diamine tetraacetate, soda, alkali silicate or mixtures thereof.

The solid cleaning agent is preferably composed in such a way that the liquefied cleaning agent can be mixed, with the associated advantages already being present at room temperature.

Once the cleaning process has ended, i.e., after the cooking chamber has been cleaned with the liquefied cleaning agent and the expended cleaning agent has been removed, rinsing with fresh water can optionally take place.

In a preferred method, a rinsing cycle can be performed immediately upon conclusion of the cleaning process or after a rinsing cycle with water, wherein rinsing takes place by means of a rinsing agent.

The rinsing agent can here be present as a liquid or in the form of a powder or granules, and held in a container with which it is supplied. In general, such rinsing agents are known, and can be used within the meaning of the present invention. A preferred composition of a rinsing agent contains one or more acids and a surfactant, especially preferably a nonionic surfactant, in particular a low-foam, nonionic surfactant.

It is especially preferable that such a container have a sealing layer at its outlet, e.g., in a bottle opening or bottle neck or the like. Such a sealing layer can preferably be a firm or waxy layer, in particular a gel, or a film in the cover. The sealing layer can also comprise a first phase of the rinsing agent.

The container for the rinsing agent can be a container completely separated from the cleaning agent, for example a second bottle. The latter can be placed in the connection unit for the cleaning agent container in the rinsing cycle after the cleaning process, or in a suitable connection unit before the cleaning process starts. In particular, the connection unit can once again be a bracket in the cooking chamber of the cooking device.

In a preferred embodiment, the container is designed as a combination container, with a cleaning agent compartment for the solid cleaning agent according to the invention described above (or the solid cleaning agent mass) and a separate rinsing agent compartment for a rinsing agent. The combination container here has parallel arranged compartments or separate, parallel chambers each preferably with separate outlet openings.

Parallel arranged compartments are here understood as a partial area of a container, for example a bottle, which has a separate opening area toward the outside of the container, so that it would in principle be possible to remove the contents of both compartments simultaneously, i.e., in parallel, as opposed to compartments that are arranged "one on top of the other" in conventional cartridges, so that the other compartment can only be reached through the one compartment.

For example, this can be realized by dividing the interior of the container into two partial areas by means of a separation unit, e.g., a partition made out of plastic or the like. Such a separation unit inside of the container can run parallel to the outer side walls of the combination container, for example.

In a preferred alternative, a container, preferably with two outlet openings or necks, is blown in such a way as to yield two closed chambers with a central web, which separate the chambers or compartments (such as partial containers) from each other, wherein in particular a separate outlet opening can be allocated to each chamber.

In another preferred alternative, two partial containers, i.e., two bottle parts, for example, can also be connected with each other in some way, e.g., via the mechanical form closure (for example, via a plug and/or tongue-and-groove connection and/or dovetail connection) and/or adhesive bonding and/or welding of the partial containers, so as to yield the compartments of a combination container. The advantage to this is that the two partial containers can be manufactured and/or filled in separate production lines, and need only be assembled at the end of the production line. Assembly can also just take place during use, for example so that the user can decide whether only one cleaning process (e.g., for a short intermediate cleaning) is to be performed, or a complete, combined cleaning and rinsing cycle. This makes sense in particular when assembly can be done simply by fitting together prefabricated plug connections of the bottles, for example.

A front end of a combination container has at least one outlet opening for the liquefied cleaning agent or rinsing agent.

This can involve a shared outlet opening for both parallel compartments. Such an outlet opening can then be divided into two outlet areas by a separation unit or partition, for example.

However, a preferred combination container has two separate outlet openings or opening stubs for the parallel compartments, for example two separate bottle necks, for the exit of the liquefied cleaning agent or rinsing agent.

The single opening tab or at least one of the opening tabs is advantageously dimensioned in such a way that this type of combination container with the respective opening stub can be introduced into a bracket for conventional cartridges fixedly mounted in a cooking chamber.

In an especially preferred method, such a combination container is also accommodated in the connection unit, in particular a bracket in a cooking chamber of the cooking device. The solid cleaning agent is here also first dissolved out of the cleaning agent compartment in a cleaning cycle. In an additional rinsing cycle, the rinsing agent is removed from the rinsing agent compartment.

Such a combination container preferably also has a solid cleaning agent, which in particular is designed as a waxy or firm gel, wherein the solid cleaning agent in particular has a water content within a range of 5% w/w to 45% w/w, preferably within a range of 10% w/w to 40% w/w, in particular within a range of 15% w/w to 35% w/w. All other components and parameters can also be designed as described above.

In another preferred embodiment, the exterior side of the compartment containing the rinsing agent, e.g., an opening tab or bottle neck or the like, contains a sealing layer. In particular, such a sealing layer can be a preferably water- and/or heat-soluble film arranged in a cover of the outlet opening, e.g., of an opening tab or bottle neck, or a corresponding wax/gel plug. Such a preferably water- and/or heat-soluble film or wax/gel plug is covered by a sealing film, which is removed by the user prior to use, i.e., before the bottle is introduced into the cooking device. This advantageously makes it possible to effectively prevent the rinsing agent from prematurely coming into contact with the user.

The sealing layer can have a variable melting temperature. In this embodiment as well, in particular in a variant where the connection unit is not arranged in the cooking chamber, [the connection unit] can be heated with a heating device or be equipped with a rinsing nozzle for dissolving the sealing layer and/or liquefying a solid rinsing agent. Therefore, the rinsing agent can advantageously also essentially be emptied from its container by increasing the temperature and/or rinsing with a rinsing nozzle, which ensures an efficient rinsing process.

To ensure a sequential and defined progression of the cleaning and rinsing process, the sealing layer of the rinsing compartment can in particular be designed so as to melt at a temperature higher than a melting temperature of the solid cleaning agent. A preferred melting temperature of the sealing layer here lies in a range exceeding the melting temperature of the solid cleaning agent. As an advantageous result, the rinsing agent is only emptied after heated to a defined temperature. The sealing layer advantageously melts at a temperature of above 70° C., preferably at a temperature of above 75° C., in particular at a temperature of above 80° C.

In an additional composition, the sealing layer can be a waxy layer, which can be melted by increasing the temperature and is only slightly water soluble, so that it can only be dissolved or initially dissolved by organic or nonpolar solvents that dissolve waxes and/or fats, for example. In general, such preferred waxes and/or fats consist of organic compounds, for example esters of fatty acids (so-called waxy acids) with long-chain, aliphatic primary alcohols. In addition, preferred axes can contain free, long-chain aliphatic carboxylic acids, ketones, alcohols and hydrocarbons. Solid paraffins and/or synthetic waxes comprised of (hard) paraffin are preferably used for such a sealing layer. In a preferred embodiment, such a sealing layer is liquefied by increasing the temperature.

A sealing layer designed in this way ensures that a solvent for dissolving the water-soluble solid cleaning agent will not also partially or completely dissolve a sealing layer for the rinsing agent, allowing the rinsing agent to undesirably exit. In this way, an advantageous sealing layer in particular prevents a liquid rinsing agent from exiting in an "overhead" position of the container, and represents a preferred embodiment. This is especially advantageous when using a liquid rinsing agent.

After a sealing layer has been dissolved, a preferred liquid rinsing agent can essentially be emptied from the container solely under its own gravity, without any additional measures being required for this purpose, for example rinsing out a rinsing agent adhering to the walls. "Essentially" is here understood as the rinsing agent being emptied from the container or rinsing agent compartment in a percentage of at least 90%w/w, preferably in a percentage of at least 95% w/w, and especially preferably in a percentage of at least 99% w/w.

In a variant, the container with the rinsing agent is positioned directly in the cooking chamber, exactly like the container with the solid cleaning agent mass, in particular the combination container with the two compartments with the solid cleaning agent mas and the rinsing agent. The rinsing cycle is here initiated after the cleaning process has ended, along with possible additional rinsing cycles with water or the like, for example by simply increasing the temperature, causing the sealing layer of the rinsing agent to melt.

As mentioned, the cleaning solution and/or diluted rinsing agent can be repeatedly circulated or pumped during the cleaning process. For example, the cleaning solution and/or diluted rinsing agent can drain through an outlet opening in the cooking chamber, as a rule an outlet sieve on the floor of the cooking chamber, and be relayed back into the circulation container or directly back to the nozzles by means of a pump. After the cooking chamber has been cleaned, the expended cleaning solution or diluted rinsing agent can drain through the outlet opening in the cooking chamber and then be removed by means of a pump and disposed of. To this end, an outlet valve can preferably be provided, so as to switch between a return to the cleaning process or rinsing process or a removal of the expended cleaning solution or diluted rinsing agent.

As mentioned, a line system is used within the framework of this method, in particular for creating a circulating loop, with one or more pumps to convey the cleaning agent and possibly the rinsing aid into and out of the cooking chamber, as was the case with the water or steam in the cooking process. A trace heater is especially preferably also provided on the line system and/or on a circulation container, for example a conventional flow heater or a heat exchanger, so as to heat up the diluted cleaning agent or rinsing agent. Alternatively, steam can also be blown into the diluted cleaning agent (i.e., the cleaning solution) or rinsing agent.

As mentioned, in an alternative dosing form (meaning not directly in the cooking chamber), the liquefied solid cleaning agent or rinsing agent can get directly out of the container and into a circulation container of the line system or circulating loop, and there potentially be mixed with the necessary quantity of solvent, in particular water, so as to set the alkalinity required for a cleaning process in the diluted cleaning agent.

In order to better dissolve and mix the liquefied cleaning agent or rinsing agent, the method can provide for a mixing device, preferably an agitator unit. In an especially preferred embodiment, once the liquefied cleaning agent or a rinsing agent has been transferred into a supply tank, mixing continues at room temperature for at least another 1 to 5 minutes, preferably for 3 minutes. According to the invention, this makes it possible to achieve an optimal homogeneity for the cleaning agent or rinsing agent, which in general can only be realized with difficulty with solid cleaners. Because the liquefied cleaning agent can be mixed, even temperature-labile constituents undergo no change, thereby continuing to ensure an optimal cleaning efficiency of the cleaning agent. If the cleaning concentrate or cleaning agent contains temperature-labile components, the provided supply tank can optionally be cooled.

In order to determine an optimal homogeneity of the dissolved or diluted cleaning agent and/or rinsing agent, specific sensors can be integrated into the cleaning device, in particular into the supply tank, which trigger an agitation interval given an inadequate homogeneity of the cleaning concentrate or cleaning agent. Even after a prolonged storage of the cleaning agent, this makes it possible to prevent potentially present higher density substances from settling, as a result of which the cleaning agent would be limited in its cleaning efficiency or even overdosed.

Of course, the expert can in part vary the sequence of the aforementioned procedural steps depending on the application or requirements thereof.

In order to prevent corrosion by a high-alkaline solid cleaning agent or from the optional use of a rinsing agent, a preferred material for the commercial cooking device is a high-alloy, stainless, semi-stainless or corrosion-resistant steel or stainless high-grade steel. Such materials preferably have a percentage of chromium exceeding 10%, and are known in prior art by the trade names Cromargan (WMF), Nirosta (Outokompu Nirosta), Remanit (Witten-Krefeld high-grade steel), or by the designation VA-steel, V2A-steel, V4A-steel, V1A-steel, V3A-steel, V5A-steel or also inox. Use can also be made of alternative corrosion-resistant alloys, such as chromium-nickel alloys, which contain less than 50% iron. In particular, the cooking chamber of the commercial cooking device is advantageously configured using a material that results in easy to clean surfaces, so as to enable a good cleaning hygiene for the commercial cooking device. Antibacterial material can here also be used.

The invention will be explained in more detail once again with reference to the attached figures based on exemplary embodiments. The same components are here provided with identical reference numbers on the various figures. As a rule, the figures are not to scale. Shown on:

Figure 1:
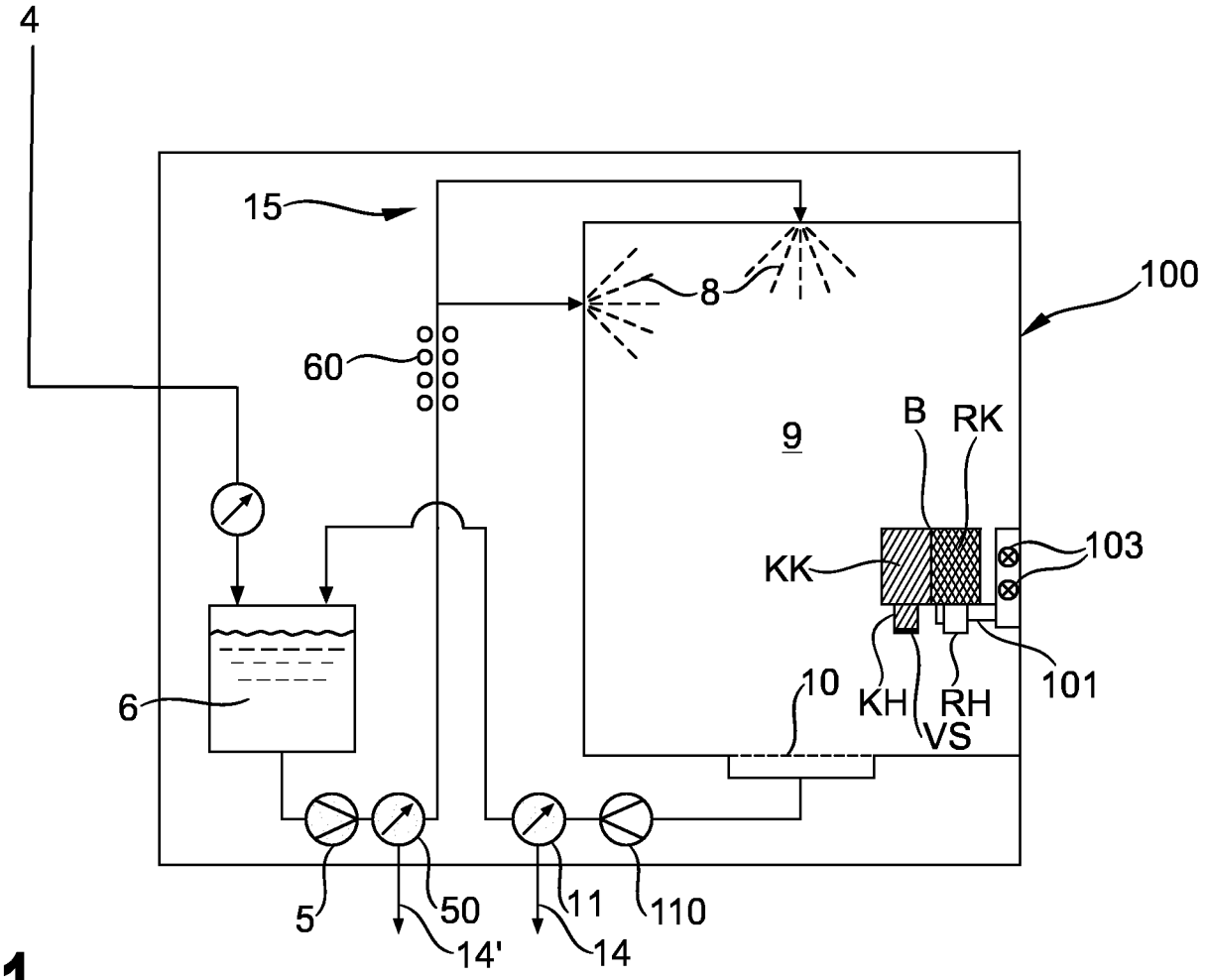
FIG. 1 is a schematic view of a commercial cooking device for explaining a first exemplary embodiment of a method for cleaning the cooking device.
Figure 4:
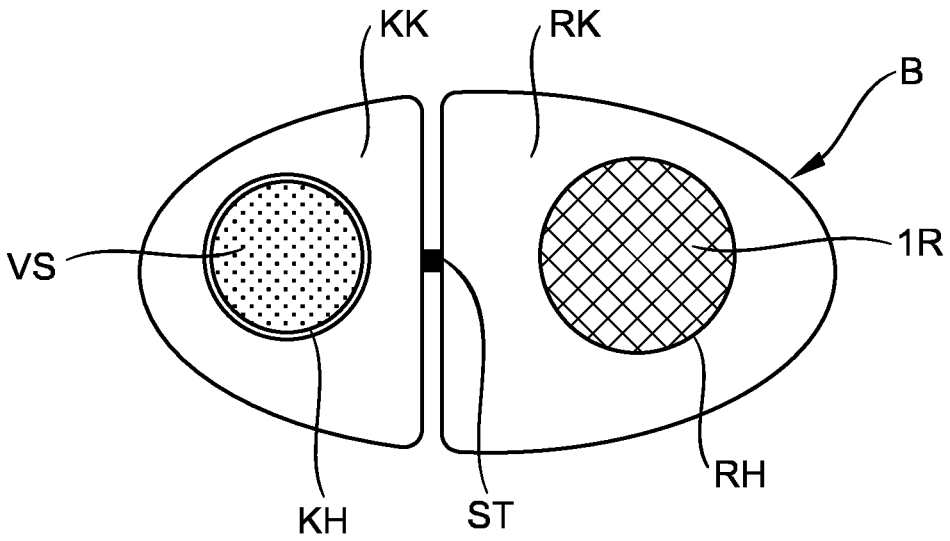
FIG. 4 is a schematic top view (similar to FIG. 3) of an upper side of a variant of a combination container with two chambers separated by a web.

FIGS. 1 and 4 each show a cooking device 100, 100', here a commercial combination steamer, with a cooking chamber 9, in which the product to be heated, in particular cooked, or the meals are introduced during operation through a door (not depicted). The cooking chamber 9 usually also contains (possibly removable) built-in components, such as rail systems, brackets or the like, so as to hold baking trays, casserole pans, etc. having a matching design. To improve clarity, these built-in components are not shown here.

A line system 15 can be used to expose the cooking chamber 9 to water, generate steam in the cooking chamber 9 or expose it directly to steam. Both the cooking chamber 9 itself, with or without built-in components, and the line systems 15 for the water or steam must be regularly cleaned.

The figures each only show the components essential for the method according to the invention. Such a method clearly can have all other conventional components, such as fans, heating devices for the walls of the cooking chamber, overhead grills, steam generators, along with a suitable controller to control the entire device in use while preparing the meals, but also when cleaning with the method according to the invention.

FIG. 1 shows a first exemplary embodiment with a cleaning device completely integrated into the cooking device 100. The cleaning device here has a connection unit 101 in the form of a bracket 101 fixedly mounted to a cooking chamber wall in the cooking chamber by means of screws 103 for accommodating a container with a cleaning agent 1R. This case can involve a bracket 101 into which the commercially available cartridges can be placed, for example.

In the present case, a combination container B, here a bottle B, with an alkaline solid cleaning agent 1R and a rinsing agent K is used for a cleaning process in this bracket 101. This combination container B here has two, as defined above as "parallel", compartments, specifically a cleaning compartment RK with the solid cleaning agent 1R and a rinsing compartment KK with the rinsing agent 1K. The combination container B here also has two separate bottle necks RH, KH respectively allocated to the compartments for the exit of the cleaning agent 1R or rinsing agent 1K.

Potential, more specific assemblies of such a combination container B, or here a combination bottle B, will be explained in greater detail below based on FIGS. 2 and 3, 4, 5.

Figure 2:
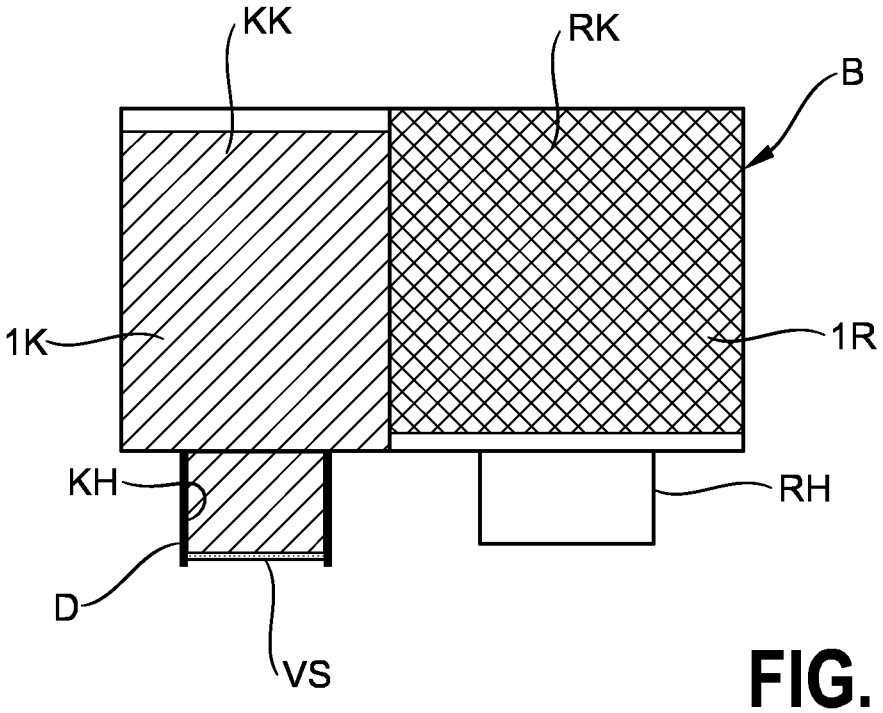
FIG. 2 is a schematic longitudinal section through a combination container with two compartments for a solid cleaning agent and a rinsing agent (the combination container is here overhead)
Figure 3:
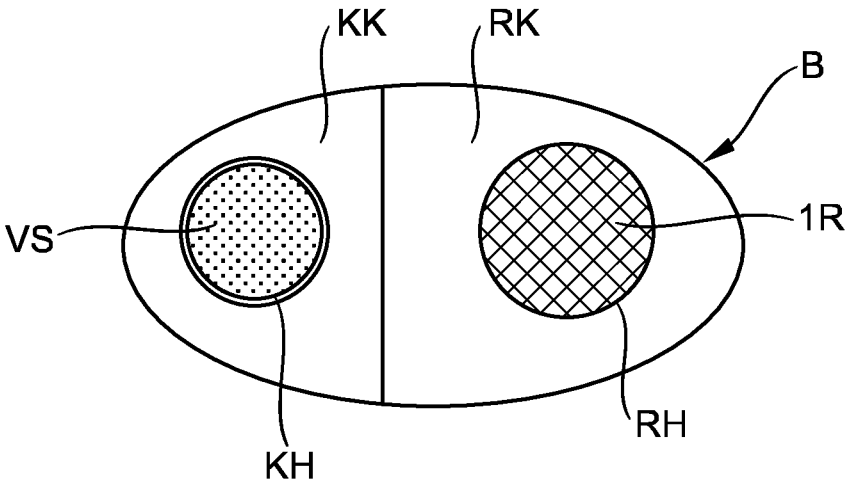
FIG. 3 is a schematic top view of the upper side of the combination container according to FIG. 2.

FIG. 2 here presents a strictly schematic view of the combination bottle as a longitudinal section through the two parallel compartments RK, KK in an "overhead" position (i.e., as during use in the cooking chamber according to FIG. 1 or in the connection piece according to FIG. 6), and FIG. 3 in a schematic top view.

As evident from these figures, the combination bottle B is essentially shaped like a cylinder with an elliptical bottom surface. The two compartments KK, RK here form a right and left part of the bottle, which are separated from each other by a partition running from the floor up to an upper end wall of the combination bottle B. On FIGS. 2 and 3, 4, 5, the rinsing agent compartment KK for the rinsing agent 1K is here respectively located on the left side, and the cleaning agent compartment RK for the solid cleaning agent 1R of the upper side is located on the right side (below on FIG. 2).

The cleaning compartment RK is here larger than the rinsing compartment KK, because more cleaning agent than rinsing agent is as a rule required for a cleaning cycle followed by a rinsing cycle.

As mentioned, the cleaning compartment RK and rinsing compartment KK are each provided with a separate bottle neck RH, KH with opening, i.e., the combination container B has two parallel bottle necks RH, KH. As a consequence, both compartments RK, KK—as opposed to previous cartridges—are parallel-accessible, and can in principle be filled and emptied independently of each other, and especially in parallel.

In one variant, the combination container B or combination bottle B can preferably be manufactured by casting a container B with two outlet openings or necks into a mold in a blowing process in such a way as to create two closed chambers with a central web ST, which separates the chambers KK, RK or compartments KK, RK from each other.

FIG. 4 presents a schematic top view of the upper side of such a dual chamber bottle with two chambers KK, RK separated by a web ST. The web ST runs from the upper side of the bottle down to the bottom side, so that no connecting opening is present between the two chambers KK, RK anymore. Therefore, a kind of dual chamber bottle B with two partial bottles is ultimately generated in this way, which are mechanically connected with each other by the web ST.

Figure 5:
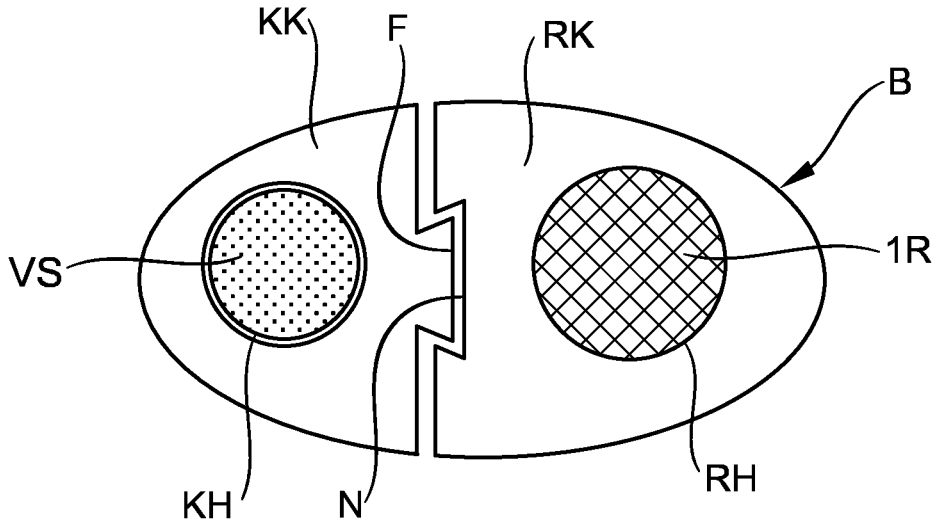
FIG. 5 is a schematic top view (similar to FIG. 3) of an upper side of a variant of a combination container with two separate chambers that can be coupled to each other.

FIG. 5 presents a principle top view of another preferred alternative for a combination container B with two separate partial containers or bottle parts. In order to manufacture such a combination container B, the bottle parts with their outlet openings are each separately manufactured, and in the process molded in such a way as to have prefabricated, matching plug connections. A plug connection in the form of a tongue-in-groove or dovetail connection is here shown by way of example. For example, a dovetailed groove N is molded into the one partial container, the cleaning compartment RK, and a matching dovetailed tongue F is molded onto the other partial container, the rinsing compartment KK. This is only shown in principle on FIG. 5. In reality, the free space depicted on the figure is clearly not present between the groove N and tongue F; rather, any kind of plug connection elements, here the groove N and tongue F as an example, are designed in terms of their dimensions and fit relative to each other so as to engage relatively tightly into each other after put together, and can preferably only be detached from each other again by a greater expenditure of force, if at all. In particular, the shape and fit of the plug connection elements along with the material of container B are here selected in such a way that even increasing the temperature does not cause the partial containers to detach from each other again. In this exemplary embodiment, both partial containers can be manufactured and/or filled in separate production lines, and need only be assembled at the end of the production line.

After the two compartments RK, KK have been filled, the bottle necks RH, KH are each provided with covers. A sealing layer VS is here located in the cover D of the rinsing compartment KK in the bottle neck, preferably in the form of a film, or in the form of a gel/wax plug. In order to protect the sealing layer VS, it is initially outwardly covered by a sealing film (not shown).

On FIGS. 2, 3, 4 and 5, the cover of the bottle neck RH of the cleaning compartment RK has already been unscrewed, and the sealing film has already been removed from the sealing layer VS on the cover D of the rinsing compartment KK. In other words, the operator has already prepared the combination bottle B for use in the cooking device 100.

In this case, the rinsing agent 1K is a liquid, which in the "overhead" position as depicted on FIG. 2, i.e., even when in a state where it is being used in the cooking device, flows downwardly and is only held back by the sealing layer VS. This sealing layer VS is designed in such a way that it can be dissolved by increasing the temperature and using steam at a suitable point in time to initiate the rinsing process, as explained below.

Since the solid cleaning agent 1R or solid cleaning agent mass is here designed as a firm gel, it remains in its original position in the bottle B in the "overhead" position, even with the cover open.

The combination bottle B with the alkaline solid cleaner 1R is then introduced into the bracket 101 in the "overhead" position with one of the two bottle necks RH, here that of the cleaning compartment RK.

As mentioned, the alkaline solid cleaner 1R is here liquefied in the bottle B with steam, which is introduced into the cooking chamber 9 by way of a line system 15 and nozzles 8, and which dissolves the solid cleaning agent 1R. The line system 15 incorporates a circulation container 6, with which fresh water can also be supplied by means of a fresh water supply 4. An (optional) trace heater 60 (here a flow heater) is additionally arranged on the line system 15, and can be used to generate the steam. The circulating system present in the cooking device and the trace heater 60 can also be used to set the cleaning solution or subsequently the rinsing agent to the desired temperature.

While and after cleaning the cooking chamber 9, the expended cleaning solution can drain out of the cooking chamber 9 through an outlet opening 10 (the conventional outlet sieve) arranged in the floor of the cooking chamber 9, and can continue to be pumped thereafter by means of a pump 110. An outlet valve 11 setting can be adjusted to determine whether the cleaning solution coming out of the cooking chamber 9 is to be pumped back into the circulation container 6 for another pass, or removed through an outlet line 14 and properly disposed of. Additionally or alternatively, the cleaning solution can also be pumped out of the circulation container 6 via the pump 5, an outlet valve 50 and an outlet line 14'. Once the cleaning process has ended, rinsing can optionally take place with fresh water, and the rinsing process can be subsequently performed.

To this end, the sealing layer VS is dissolved through a continued temperature increase and exposure to steam, so that gravity moves the rinsing agent 1K into the cooking chamber 9. Similarly to the cleaning agent, the rinsing agent 1K can then be carried by a circulating system, and then disposed of after use similarly to the expended cleaning agent.

Figure 6:
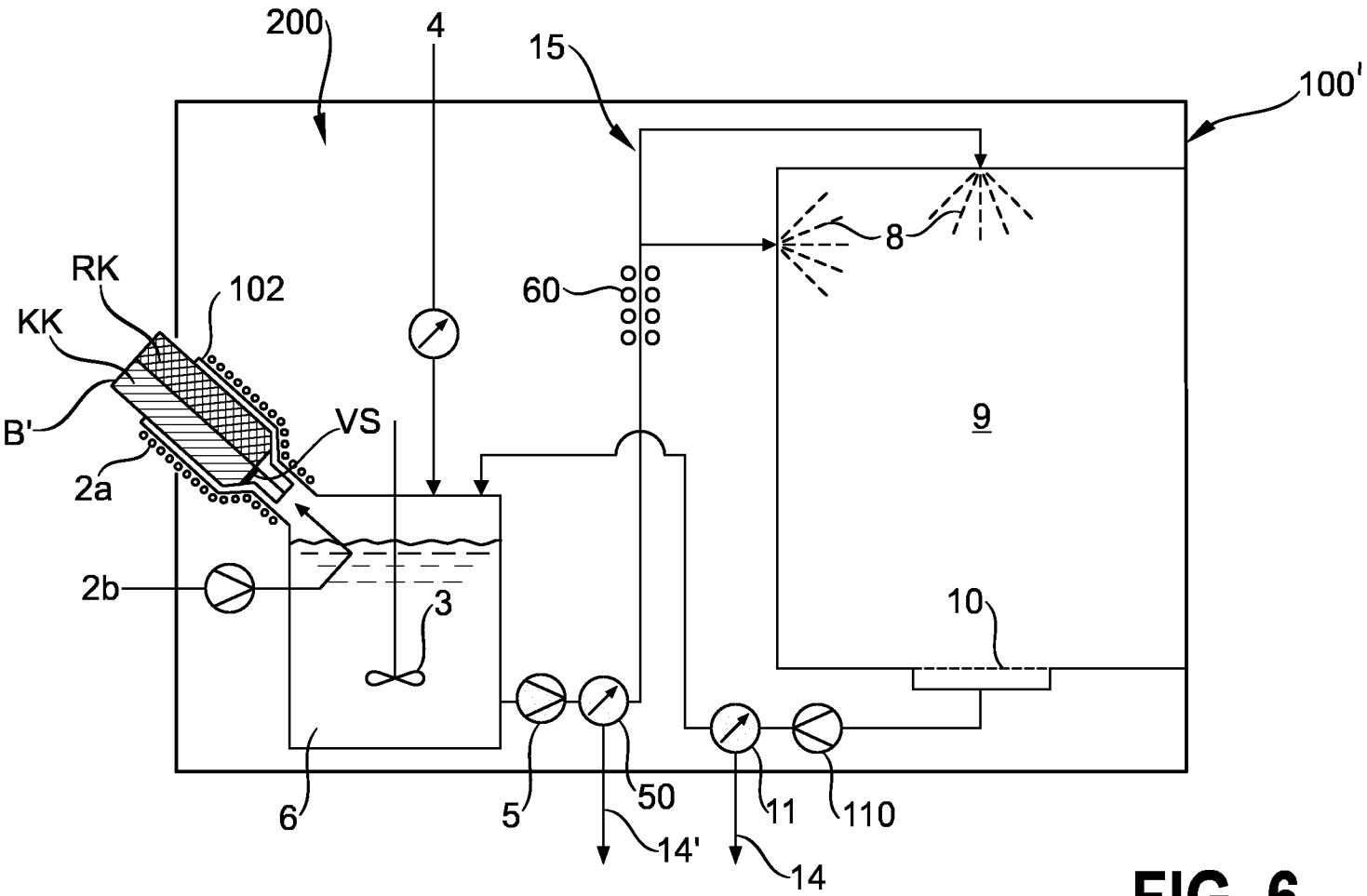
FIG. 6 is a schematic view of a commercial cooking device for explaining another exemplary embodiment of a method for cleaning the cooking device.

FIG. 6 shows another exemplary embodiment for a method with a cleaning device 200 integrated into the cooking device 100', in which the combination container B' is docked to a connection unit 102 in the form of a connection piece 102 fixedly mounted in the cooking device outside of the cooking chamber 9.

Here as well, the combination container B' is designed in the form of a combination bottle, and also comprises a respective cleaning compartment RK with a solid cleaning agent 1R, in the present case a firm gel, as well as a rinsing compartment KK with a rinsing agent 1K. However, the combination container here has only a shared bottle neck in the schematic illustration. The bottle neck of the combination container B' is divided into two separate bottle opening parts by a partition, and thereby allows the liquefied cleaning agent 1R or rinsing agent 1K to exit separately. A sealing layer VS is again located inside of the bottle opening part for the rinsing agent. In principle, such a combination container with only one shared bottle neck is possible. However, in terms of practical implementation, the bottle can for the sake of simplicity be designed like a dual chamber bottle with two chambers or partial bottles and separate neck openings, as described above. In this case, the connection piece 102 is correspondingly adjusted to the dual chamber bottle.

The combination bottle B' is here introduced into the connection piece 102 with a bottle neck in an "overhead" position. Prior to placement in the connection piece 102, a usually present cover of the bottle neck of the combination bottle B' is removed.

The liquefaction device for liquefying the alkaline solid cleaner 1R in the bottle B' here has a heating device 2*a* around the connection piece 2, with which the container B' along with the solid cleaning agent 1R can be heated. In particular, such a heating device 2*a* can be electrical, designed for warm water or condensing steam. In addition, the liquefaction device is here equipped with a rinsing nozzle 2*b*, so as to expose the solid cleaning agent 1R (alternatively or additionally to heating the solid cleaning agent 1R) to a jet of solvent through the bottle neck (without loss of generality, it is assumed below that the solvent is water and/or steam), which dissolves the solid cleaning agent 1R.

The connection piece 102 is here arranged at an upper end of the supply tank 6, which here is formed by the circulation container 6, so that the liquefied cleaning agent 1R is moved out of the container B' and into the supply tank 6 by gravity as a kind of "cleaning concentrate".

Furthermore, a fresh water supply 4 can be used to feed additional fresh water into the supply tank 6 to further dilute the liquefied cleaning agent 1R. In order to better dissolve and mix the liquefied cleaning agent or rinsing agent for obtaining a cleaning solution with the desired homogeneity or alkalinity, the supply tank 6 has a mixing device 3, here an agitator unit 3. In order to clean the cooking chamber 9 and line system 15, a pump 5 can be used to introduce the cleaning solution provided in the supply tank 6 into the cooking chamber 9 through the line system 15 and via inlet openings 8, in particular nozzles 8.

An (optional) trace heater 60 (here a flow heater) is here additionally arranged on the line system 15, and can be used to set the cleaning solution to a desired temperature.

While and after cleaning the cooking chamber 9, the expended cleaning solution can here as well drain out of the cooking chamber 9 through an outlet opening 10 (the conventional outlet sieve), and can continue to be pumped thereafter by means of a pump 110. An outlet valve 11 setting can again be adjusted to determine whether the cleaning solution coming out of the cooking chamber 9 is to be pumped back into the circulation container 6 for another pass, or removed through an outlet line 14 and properly disposed of. Additionally or alternatively, the cleaning solution can also be pumped out of the circulation container 6 via the pump 5, an outlet valve 50 and an outlet line 14'. Once the cleaning process has ended, rinsing can optionally take place with fresh water.

Once the cleaning process is complete and the expended cleaning agent has been removed, the rinsing agent 1K is released in a second step by dissolving the sealing layer VS, i.e., the film or the like, by increasing the temperature and/or using rinsing nozzles, and essentially transferred into the supply tank 6 or circulation container 6. The rinsing agent 1K is subsequently further liquefied in the supply tank 6, if necessary while supplying fresh water via a fresh water supply 4 and using an agitator unit 3. In the rinsing cycle, the rinsing agent is then introduced as needed into the cooking chamber 9 by means of a pump 5 via the line system and nozzles 8. After the rinsing process is over, the expended rinsing agent is disposed of via the outlet opening 10 and pump 110, the valve 11 and the outlet line 14. Here as well, the rinsing agent could be initially returned from the cooking chamber 9 into the circulation container 6 for another pass.

Finally, let it be noted once again that the devices described in detail above only involve exemplary embodiments, which can be modified by the expert in a wide variety of ways, without departing from the area of the invention. In particular, for example, the supply tank could also be omitted, and the liquefied cleaning agent and/or rinsing agent could also be guided directly in the line system 15, if necessary in a circuit. In like manner, for example, even when using the container B directly in the cooking chamber, a liquefaction device could be used in the cooking chamber for liquefying the solid cleaning agent in the container, for example a rinsing nozzle, with which solvent can be sprayed directly into the container, e.g., from below. As in the variant according to FIG. 6, a combination container B' with only one bottle neck could also be placed directly in the cooking chamber in the procedural variant according to FIG. 1 or vice versa. In principle, the solid cleaning agent, in particular the solid gel, could also be combined with known rinsing agent variants, e.g., rinsing agent tabs, which are added via a dispenser drawer, or rinsing agent tabs in a temperature-controlled, water-soluble film, which can be placed in the cooking chamber. Furthermore, use of the indeterminate article "a" or "an" does not mean that the respective features cannot also be present repeatedly. Likewise, the term "unit" does not mean that the latter cannot also consist of several, potentially even spatially separated, subunits.

REFERENCE LIST

1K Rinsing agent
1R Solid cleaning agent
2*a* Heating device of the liquefaction device
2*b* Rinsing nozzle of the liquefaction device
3 Mixing device/agitator unit

4 Fresh water supply
5 Pump
6 Supply tank/circulation container
8 Inlet openings/nozzles
9 Cooking chamber
10 Outlet opening
14, 14' Outlet line
15 Line system
50 Outlet valve
60 Trace heater
100, 100' Cooking device
101 Connection unit/bracket
102 Connection unit/connection piece
103 Screws
110 Pump
200 Cleaning device
B Combination container/combination bottle
B' Combination container/combination bottle
RK Cleaning agent compartment
KK Rinsing agent compartment
RH Bottle neck, cleaning agent compartment
KH Bottle neck, rinsing agent compartment
VS Sealing layer
D Cover
ST Web
F Tongue
N Groove

The invention claimed is:

1. A method for cleaning a commercial cooking device, in which a container with a solid cleaning agent comprising a solid gel, is accommodated in a connection unit of the commercial cooking device, and in which the solid cleaning agent is liquefied in the cleaning process in the container by means of heat and/or a solvent, in order to generate a liquefied cleaning agent, wherein, after the cooking chamber has been cleaned with liquefied cleaning agent, expended cleaning agent is removed, and a rinsing cycle is performed, in which rinsing takes place by means of a rinsing agent, and wherein a combination container is accommodated in the connection unit of the cooking device, the combination container has parallel arranged compartments with separate outlet openings, one of the compartments is a cleaning compartment with the solid cleaning agent, and another compartment is a rinsing compartment with a rinsing agent.

2. The method according to claim 1, wherein the container with the solid cleaning agent is accommodated in a bracket fastened in the cooking chamber of the cooking device.

3. The method according to claim 1, wherein the rinsing agent is supplied in a container, with a sealing layer being arranged on its outlet.

4. The method according to claim 1, wherein the solid cleaning agent is liquefied in the cleaning process in the container by water and/or steam.

5. A method for cleaning a commercial cooking device, in which a container with a solid cleaning agent comprising a solid gel, is accommodated in a connection unit of the commercial cooking device, and in which the solid cleaning agent is liquefied in the cleaning process in the container by means of heat and/or a solvent, in order to generate a liquefied cleaning agent, wherein the container with the solid cleaning agent is accommodated in a connection unit that is separate from the cooking chamber, and has an allocated liquefaction device including a heating device and/or rinsing nozzle, and the liquefied cleaning agent is transferred into the cooking chamber of the cooking device via a line system comprising a pump.

* * * * *